United States Patent [19]

Papayoti

[11] 3,948,012

[45] Apr. 6, 1976

[54] SPACE FRAME SUPPORT SYSTEM

[76] Inventor: Hristo V. Papayoti, 2886 Sorrento, Ann Arbor, Mich. 48104

[22] Filed: May 24, 1973

[21] Appl. No.: 363,366

[52] U.S. Cl. ..... 52/263; 52/648; 52/650

[51] Int. Cl.[2] ..... E04C 3/02

[58] Field of Search ..... 52/637, 638, 263, 648, 52/650

[56] References Cited

UNITED STATES PATENTS

| | | | |
|---|---|---|---|
| 2,979,169 | 4/1961 | Yolles | 52/655 |
| 2,986,241 | 5/1961 | Fuller | 52/655 |
| 3,402,557 | 9/1968 | Steele | 52/637 |
| 3,415,027 | 12/1918 | Snyder | 52/655 |
| 3,421,280 | 1/1969 | Attwood | 52/648 |
| 3,443,348 | 5/1969 | Papayoti | 52/648 |
| 3,564,802 | 2/1971 | Dreyfus | 52/637 |
| 3,685,221 | 10/1969 | Manyan | 52/DIG. 10 |

OTHER PUBLICATIONS

Space Grid Structures by John Borrego, 1968.

*Primary Examiner*—Ernest R. Purser
*Assistant Examiner*—Henry Raduazo

[57] ABSTRACT

A support structure for a space frame system of the type wherein an upper chord frame and a lower chord frame structure are formed of a plurality of strut members connected to each other and held together by a plurality of like connecting fixtures. A support column is included for connection to the connecting fixtures by one or more intermediate beams carried at the top of the support column. The structure is designed to support multiple deck space frames and space frames covering multiple modules in such manner as to distribute the load and stress characteristics of the space frames dependently one of the other through the column. Different embodiments include diagonal column arm supports and systems in which there are included either one-way or two-way support beams interconnected with the chord frames of two or more of the space frames. The present disclosure also illustrates arrangements whereby the column arm is itself connected by a second vertically spaced cross arm of similar load bearing characteristics and having similar interconnections with the multiple space frame elements to increase the load carrying and shearing capacity of the space frames.

21 Claims, 21 Drawing Figures

SPACE FRAME SUPPORT SYSTEM

BACKGROUND OF THE INVENTION

I. Field of the Invention

The present invention relates to building construction and, more particularly, to support structures for large span, multiple deck space frame systems and for multiple module frames which are accordingly capable of providing high load carrying capacity.

II. Description of the Priot Art

The C. W. Attwood U.S. Pat. No. 3,270,478, C. W. Attwood et al. U.S. Pat. No. 3,421,280 and the H. V. Papayoti U.S. Pat. No. 3,443,348, all of common ownership herewith, disclose a standardized system for space frame construction involving the use of lightweight, freely interchangeable elements of high quality material, manufactured to close tolerances that can be assembled at relatively low cost even by comparatively inexperienced workers to form structures varying greatly in design and capable of being readily disassembled, altered or expanded to meet the changing needs of the user, the components being almost 100% salvageable. Such a flexible type of structural framework is well suited for many different types of buildings, pavilions, three dimensional trusses, docks, structural spans and the like. In addition, such a structural framework meets not only the requirements of flexibility, standardization and quality, but is capable of carrying large loads and can be engineered to form space enclosures of various sizes and shapes instead of being limited within certain overall fixed dimensions as is the case with conventional structures.

As disclosed in the aforesaid patents, a space frame is a structure in which forces act in three or more directions in space. The structure uses four substantially standardized basic parts; namely, connecting fixtures, struts, bolts and nuts. The connecting fixture is a preformed universal element having horizontally and angularly located seats with accurate locating and securing means included to which the struts are attached by the nuts and bolts. The space frame systems can be applied in assemblies of roof span constructions as well as floors, ceilings, sidewalls and other like structures.

Until the appearance on the market of the space frames known by the trademarks "UNISTRUT" and "ATTWOOD SYSTEM," trusses and the like used in floors, roofs and other building parts were either welded together and carried to the construction site or were assembled by welding, riveting or bolting in the field. Specified and predrawn parts, which individually were adapted for only one specialized use, had to be altered in size and form as the construction progressed. The shortcomings and the inconveniences of prior construction systems were overcome by the space frame system of construction utilizing lightweight, easily handled modular parts. Since these parts are manufactured in large quantities and are accurately dimensioned, the interchangeability of the parts is a prime advantage. The precision and accuracy with which the parts are made in the factory insure speed and proper results in assembly. The parts arrive on the site prefinished and are readily joined together. Workmen do not have to use tapes or squares in assembly and the simplicity of assembly even permits employment of relatively unskilled labor. Such space frame structures provide a building construction having a roof structure and a floor structure that are held in a rigid column support system to provide ready and reliable basic construction.

One problem which arose was that of providing a support structure which in combination with the support column would lend sufficient support to a multiple deck space frame capable of supporting greatly increased loads and generally extending laterally over not one but two or more modules. Support columns and column arm arrangements known to the prior art proved inadequate to afford support to the relatively wide span multiple deck space frames and there was the need of structural capacity and reasonably minimum deflection of the support column arm members.

It thus became a problem to provide a support structure which would support greatly increased loads and transmit the stresses involved in a space frame arrangement without disrupting its basic geometry, the structural unity and simplicity of its parts.

SUMMARY OF THE INVENTION

The present invention will be described subsequently in greater detail as adapted to be used with a plurality of space frames vertically arrayed one relative to the other in a multiple deck arrangement of such space frames, each of which itself comprises a separate space frame system including a lower chord frame structure and an upper chord frame structure disposed in parallel and substantially horizontally disposed planes. A stress distributing web structure spaces and interconnects each lower and upper chord frame structure of each separate space frame assembly and it will be recognized that in multiple deck installations adjacent upper and lower chord frame structures comprise a common intermediate chord frame structure. In accordance with the basic space frame concept, the several chord frames and web structures are formed of stress carrying channel formed strut members interconnected through standardized connecting fixtures regularly spaced along a plurality of longitudinal and lateral rows.

The present invention more particularly comprises a support structure associated with the support columns and the several space frames which cooperate with one or more of the chord frame structures through the several fixtures included therein to distribute the load of the multiple decked space frames in such manner as to increase the capacity of the space frame structure. The system further includes column arms or cross beams employed to add to the load carrying capacity of the space frame structure and even further includes a plurality of properly dimensioned upper cross arms which are fixed to the column arms and add to the shearing capacity of the space frames. Support by the column arms is applied to the intermediate chord of a space frame to add to the number of maximum load carrying web struts.

Other objects, advantages and applications of the present invention will become apparent to those skilled in the field of space frame systems when the accompanying description of several examples of the present invention is read in conjunction with the accompanying drawings.

BRIEF DESCRIPTION OF THE DRAWINGS

The description herein makes reference to the accompanying drawings wherein like reference numerals refer to like parts where they occur throughout the several views, and in which.

DETAILED DESCRIPTION

Figure 1:
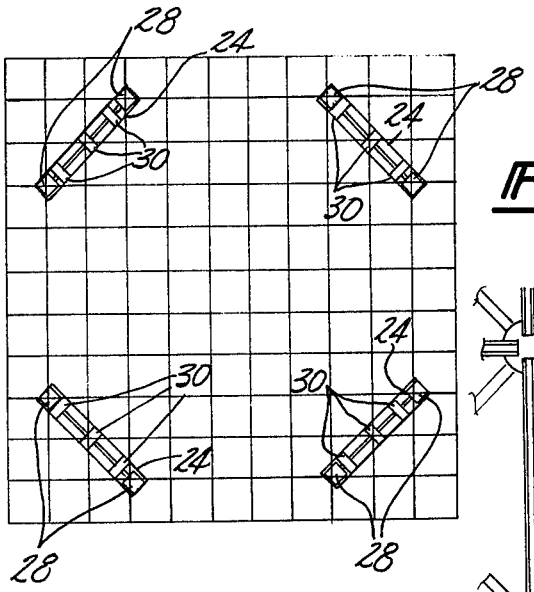
FIG. 1 is a schematic top plan view of one embodiment of this invention.

Referring now to the drawings and, more particularly to FIGS. 1–4, these illustrate an example of a square, or a rectangular close to square layout, where one point column supports would not have the load bearing capacity required. A diagonal one-way column arm arrangement as illustrated provides the necessary moment carrying and shearing capacity of the structurue. The reactions at the ends of the arms would be exactly equal for square structures and therefore would not induce overturning moments to the supporting column. Furthermore, in rectangular layouts close to square, the reactions at the ends of the arms would be reasonably close and the resulting induced moment to the columns would not be of excessive values.

Figure 1A:
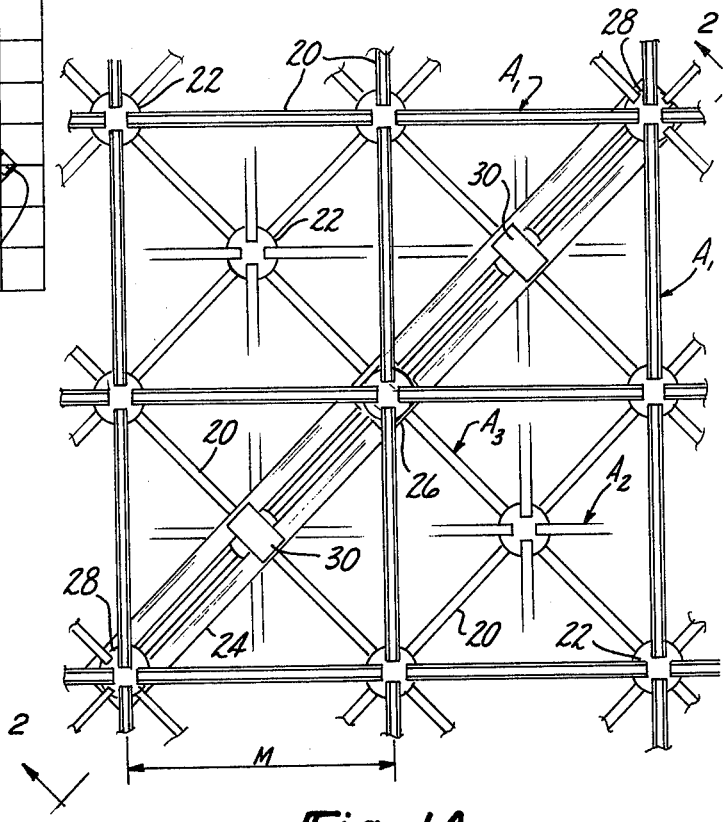
FIG. 1A is a fragmentary plan view of the top of a space frame structure constructed in accordance with the principles of the present invention.
Figure 2:
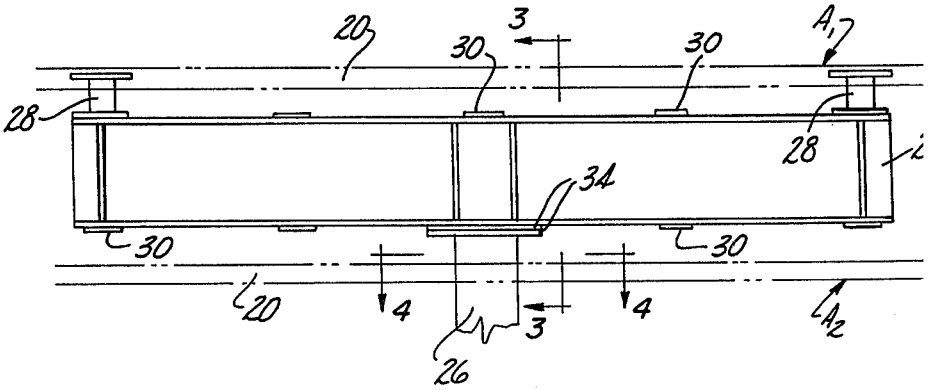
FIG. 2 is a fragmentary side elevational view taken along the section lines 2—2 of FIG. 1A showing a portion of the structure illustrated in FIG. 1.

The space frame structure itself, as shown in FIGS. 1A and 2, comprises an upper chord frame structure $A_1$ and a lower chord frame structure $A_2$ held in spatial relationship by means of an intermediate web structure $A_3$. The upper and lower chord frame structures and the web structures are preferably assembled from a plurality of back-to-back struts 20 which are preferably channel shaped and are well known to the trade as being marketed under the trade name "UNISTRUT."

The upper and lower chord frame structures $A_1$ and $A_2$ further include a plurality of connecting fixtures 22, which fixtures are particularly described in detail in the aforementioned U.S. Pat. No. 3,270,478 and include a plate-like member provided with a horizontal or plane portion having a first plurality of seats which are horizontally oriented, while a second plurality of seats are included which are angularly oriented. The strut members 20 are mounted to the connecting fixtures 22 through bolt and nut fasteners which pass through aligned apertures in each strut member and through mating apertures in the connecting fixture, which will be better shown in FIG. 18 hereinafter. The struts 20 and fixture 22 are further aligned and interlocked through mating lug and aperture arrangements which are explained in detail in the aforementioned patents. The web strut members 20 are preferably attached to the opposite surfaces of the connecting fixtures 22 in both the upper and lower chord frame structures $A_1$ and $A_2$. The space frame structure thus formed has an upper chord frame structure $A_1$ which lies in a plane parallel to the plane of the lower chord frame structure $A_2$, the strut members 20 in each chord frame structure being arranged in squares as shown in FIG. 1, with the intersection of the squares of one plane being vertically opposite to the center of squares in the other plane as best shown in FIG. 1A. The intersection of the squares in one plane are joined to those in the other plane by the diagonally arranged web strut members 20 forming the web structure $A_3$ such that the resulting structure consists of a plurality of four-sided pyramids set together right-side-up and up-side-down with all edges of the same length. In such a space frame arrangement, a single connecting fixture 22 may accommodate as many as eight pairs of struts 20, with each pair of struts 20 being secured to the appropriate seat of the connecting fixture 22.

Also shown in FIGS. 1 and 1A is a diagonally arranged column arm member 24 which is fixed to the top of the vertical support column 26 in a manner which will be better shown in the drawing of FIG. 2. The column arm member 24 is indicated in its diagonal position relative to one module $M^2$ of the space frame, which module typically may be 4 or 5 feet on a side, or any other standard dimension. It will further be seen that the column arm member 24 is a doubled beam which includes at its ends a pair of upstanding seat fittings 28 which are attached to and serve to provide support to the opposed fixtures 22 in the upper chord frame $A_1$. A spaced plurality of tie plates 30 are connected by welding to the upper beam surfaces of the column arm member 24. A second plurality of tie plates 30 are fixed to the lower beam surfaces of the column arm member 24.

FIG. 2 shows the manner in which the diagonal column arm member 24 is centrally fixed to the top of the vertical support column 26 through a pair of flat plates 34 welded together or otherwise fastened to the bottom of the diagonal column arm member 24 and to the top of the vertical support column 26 respectively.

Figure 3:
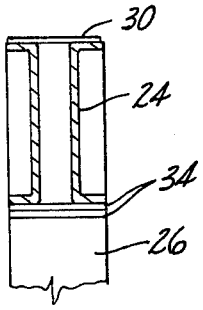
FIG. 3 is a sectional view taken along the lines 3—3 of FIG. 2.

FIG. 3 shows the cross-sectional configuration of the diagonal column arm member or beam 24 and the plates 34 which connect the column arm member 24 to the top of the vertical support column 26. Also shown is one of the tie plates 30.

Figure 4:
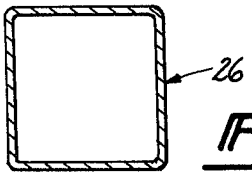
FIG. 4 is a sectional view taken along the lines 4—4 of FIG. 2.

FIG. 4 shows the cross-sectional configuration of the support column 26 which is preferably that of a square tube member as illustrated. It will be understood that the support column 26 at its lower end is properly anchored to the ground or floor structure through appropriate conventional means.

The embodiment shown in FIGS. 1–4 is therefore one wherein a space frame spanning a plurality of standard module widths is supported in a secure and rigid manner by the column arm member 24 which is diagonally oriented relative to the upper chord frame $A_1$ of the space frame structure and interconnected to the fittings of the upper chord frame structure $A_1$. In this manner the load of the space frame is properly distributed to at least two support fixtures and thence transferred to the support column 26.

Figure 5A:
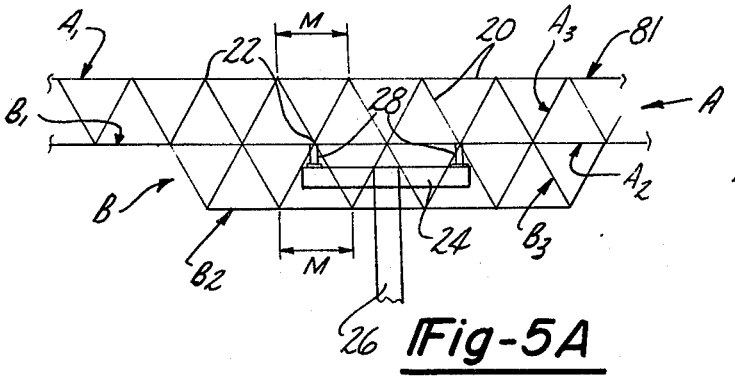
FIG. 5A is a diagrammatic elevational view of the structure of FIG. 5.
Figure 5:
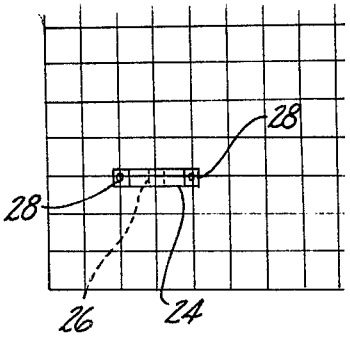
FIG. 5 is a schematic top plan view showing the intermediate chord layout of a multiple-decked embodiment of the present invention.

FIGS. 5 and 5A show a different embodiment of the present invention in which the space frame support structure is adapted to lend support to a multiple deck space frame. The embodiment illustrated includes an assembly of two space frames A and B, although it will be understood that the invention can as well be applied to three, four or even more space frames connected in a multiple-decked arrangement. The side span of a conventional module is again indicated by the letter M in FIG. 5A.

Figure 6:
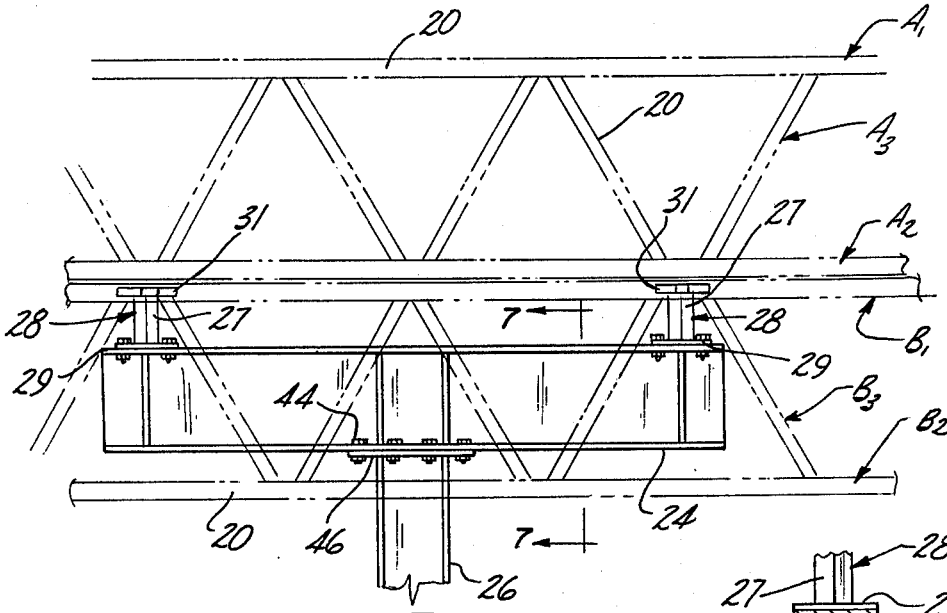
FIG. 6 is a fragmentary elevational view to enlarged scale showing the detail of certain of the parts used in the construction of the FIG. 5A structure.

As seen in FIG. 6, the upper space frame A includes an upper chord frame $A_1$ and a lower chord frame $A_2$ spaced by a web frame $A_3$, while the lower space frame B includes an upper chord frame $B_1$ and a lower chord frame $B_2$ spaced by a web frame $B_3$, the lower frame $A_2$ and upper frame $B_1$ functioning together as an intermediate chord frame structure.

Figure 7:
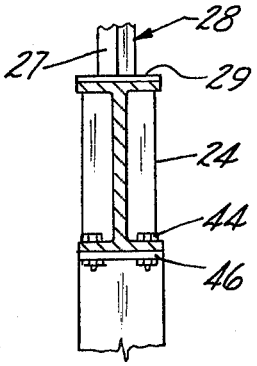
FIG. 7 is a sectional view taken along the lines 7—7 of FIG. 6.

The support arrangement for the double-decked space frame includes the support column 26 and the column arm member 24 fixed to the top of the column support 26 and carrying at its opposite ends a pair of seat fittings 28 substantially similar to those shown in connection with the FIG. 1 embodiment. In each case the seat fitting 28 comprises a post 27, a base plate 29 which is welded or bolted or otherwise attached to the upper surface of the column arm member 24, and an upper cross shaped seat member 31 which is connected to the opposed fixtures 22 of the common intermediate chord frame as will be more clearly shown in FIG. 19 hereinafter. The column arm member 24 is centrally attached by through bolts 44 to a plate 46 fixed at the upper end of the support column 26. The respective chord frame structures $A_1$, $A_2$ and $B_1$ and $B_2$ are illustrated in their relationship to the column arm member or beam 24 and the seat fittings 28. The cross shaped seat member 31 has apertures adapted for bolting it to the upwardly opposed connecting fixtures 22 in the intermediate chord frame. In this way the one-way column arm member 24 lends support to both the upper and lower space frames and properly distributes their weight and the weight of any load carried by them to the support column 26. The double-decked space frame structure has more load carrying capacity due to the increased depth. The support structure according to the present invention greatly increases the number of web struts connected to each seat fitting thus increasing the load carrying capacity. FIG. 7 shows the general cross-sectional configuration of the cross member 24, which will be seen to be of the W-beam (wide flange) type section.

Figure 8:
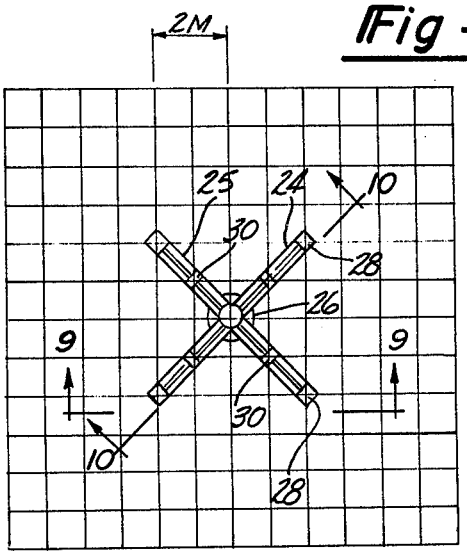
FIG. 8 is a schematic top plan view of another column support arrangement constructed in accordance with the present invention.
Figure 9:
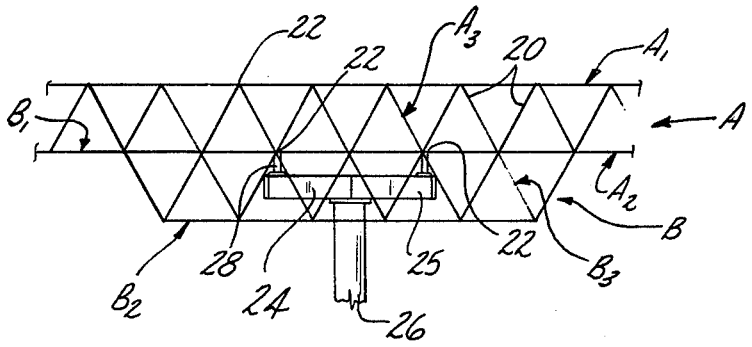
FIG. 9 is a diagrammatic elevational view of the embodiment of FIG. 8.
Figure 10:
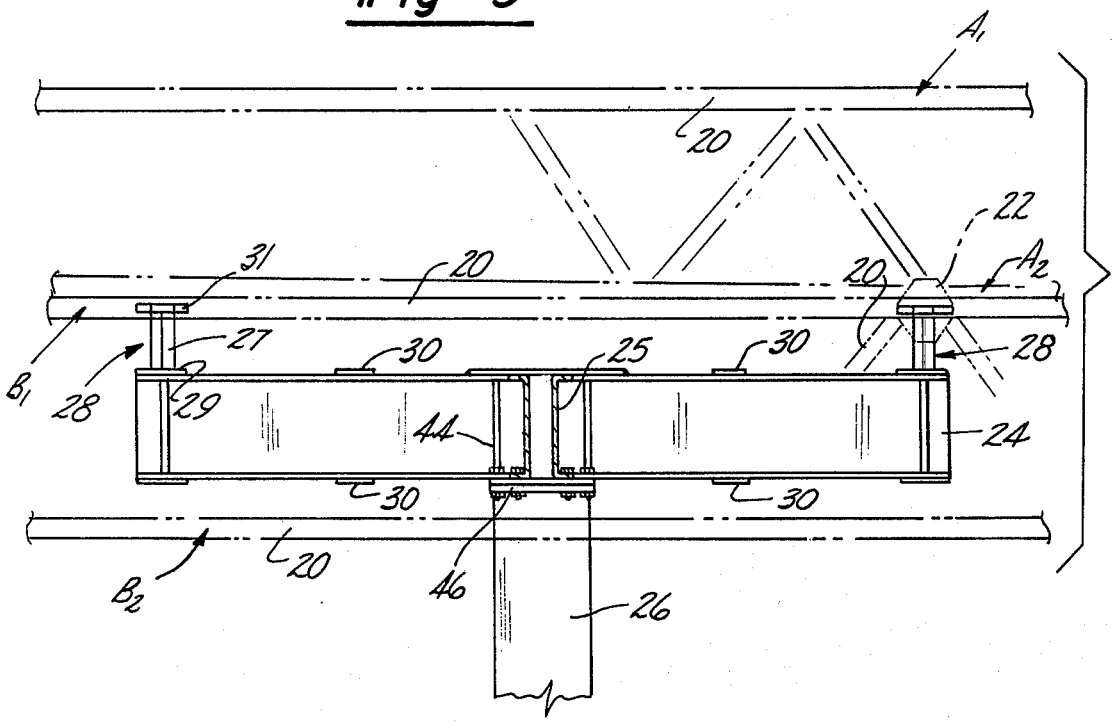
FIG. 10 is a fragmentary detail elevational view to enlarged scale showing the basic parts of the embodiment of FIGS. 8 and 9.

FIGS. 8–10 illustrate a different embodiment of the double-decked space frame assembly supported on diagonal two-way column arms. It includes a pair of diagonal column arm members 24 and 25 arranged in the manner illustrated in FIG. 8. The grid illustrated shows the substantially modular arrangement to which the support structure provides supporting condition. The basic parts of the space frame shown in the FIG. 9 view include the upper deck space frame A with upper chord frame $A_1$, lower chord frame $A_2$, and web frame $A_3$; and the lower deck space frame B with its upper chord frame designated $B_1$, its bottom chord frame designated $B_2$, and its web frame designated $B_3$. The two space frames thus have in common the elements of their lower and upper chord frames, respectively, to form a common intermediate chord frame. The column arms 24 and 25 are substantially normal one to the other and both include seat fittings 28 at their ends in the manner illustrated in connection with the prior embodiment of FIG. 6.

FIG. 10 additionally shows the manner in which the diagonal column arm 24 supports the intermediate chord frame designated as $A_2$. The diagonal column arm 25, like the diagonal column arm member 24, is preferably a beam with stiffener plates added as required, and it is shown in end view in FIG. 10. A plurality of tie plates 30 are symmetrically arranged and welded across the upper surface of the column arm 24, while a second plurality of tie plates 30 are welded on the lower surface of the diagonal column arm 24. In this manner the double-decked space frame stresses are communicated through both of the diagonally arranged column arms 24 and 25 to provide proper distribution of the load through the column arms 24 and 25 and finally to the vertical support column 26. The double-decked space frame structure has more load carrying capacity due to the increased depth. The support structure according to the present invention greatly increases the number of web struts connected to each seat fitting thus increasing the load carrying capacity.

Figure 11:
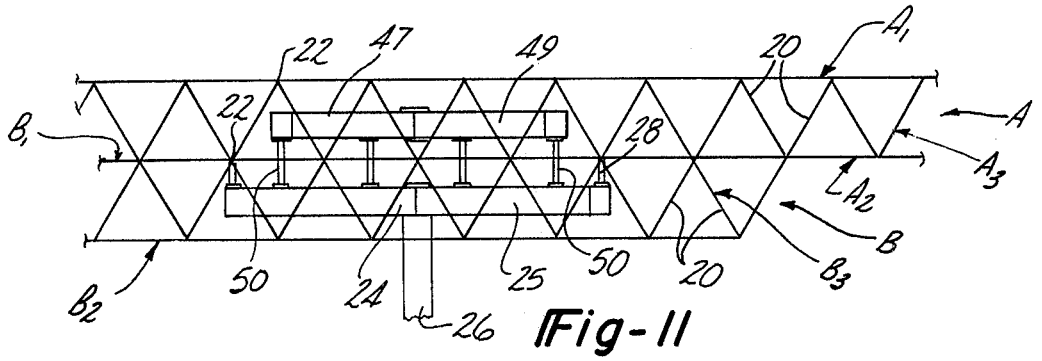
FIG. 11 is a diagrammatic elevational view of a different embodiment of the present invention shown including a second cross arm in combination with the first.
Figure 12:
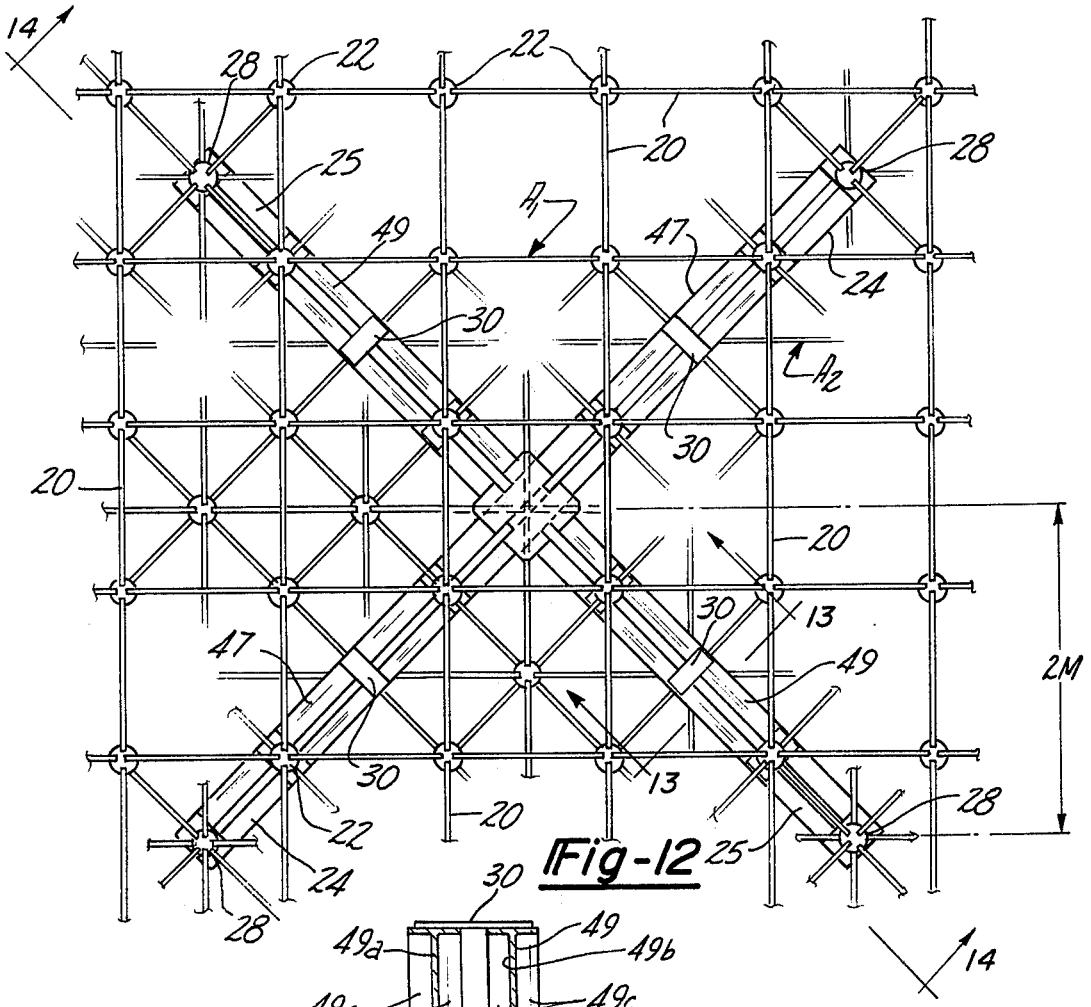
FIG. 12 is a fragmentary top plan view showing the detail of the embodiment of FIG. 11.

FIGS. 11–14 show a still further embodiment of the present invention which may be characterized as being a support structure for a double-decked space frame which includes a diagonal two-way column arm member arrangement. The double-decked space frame arrangement shown in FIG. 11 is the same as the one previously illustrated in FIG. 9, and the upper and lower chord frames of the two space frames respectively form the common intermediate chord frame. It will be noted that in a like manner to the FIG. 9 embodiment, the lower of the two space frames is of a somewhat lesser span than the upper. The two space frames are held in vertically spaced relationship by a number of intermediate web struts 20. The arrangement of the supports for the column arms 24 and 25 is provided through a second pair of column arms 47 and 49 which are mounted thereabove. The column arms 47 and 49 are each parallel to their associated column arms 24 and 25 and are of somewhat shorter length. As shown in the FIG. 11 drawing, a plurality of posts 50 are used to connect the vertically aligned pairs of cross arm members together. This manner of interconnection and the manner in which the chord frames are further connected to the column arms is shown in greater detail in FIG. 14 hereinafter. It will be seen that the basic function of the upper column arms 47 and 49 is to form an integrated structural frame assembly with more load carrying capacity in longer span and relatively small deflection under load. FIGS. 8 and 12 show the manner in which the column arms extend diagonally across two or more modules M.

Figure 13:
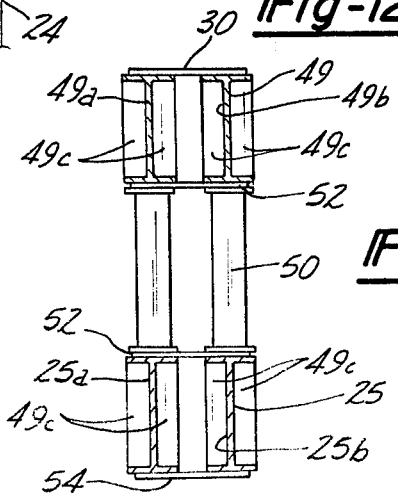
FIG. 13 is a sectional view taken along the lines 13—13 of FIG. 12.

FIG. 13 illustrates the basic construction of one of the column arms 49, which will be seen to include a pair of beam members 49*a* and 49*b* which have welded to their upper and lower surfaces a pair of plates 52 and 30. Also illustrated is the construction of column arm 25 which includes beam members 25*a* and 25*b* which have welded to their upper and lower surfaces a pair of plates 52 and 54.

Figure 14:
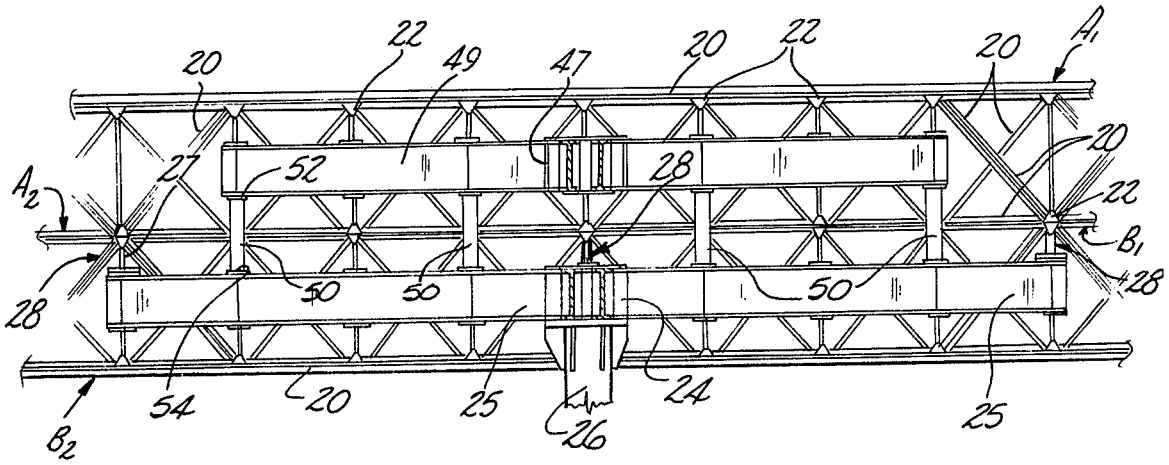
FIG. 14 is a fragmentary side elevational view showing the detail of the embodiment of FIG. 12 and taken along the section lines 14—14 of FIG. 12.

With reference to FIG. 14, there is shown the manner in which the aligned column arms 25 and 49 cooperate with each other, with the support column 26 and the double-decked space frame assembly. It will be seen that each of the posts 50, four in number, includes a top plate 52 and a bottom plate 54 which are welded or bolted to the respective opposed surfaces of the column arm members 25 and 49. A pair of seat fittings 28 are mounted at the ends of the column arm member 25 and include a vertical post portion 27 which terminates at its upper end in a connecting cross-shaped seat 31, as shown in FIG. 10, which seat is bolted to the opposed fixtures 22 in the intermediate chord frame structure. Also shown is an end view of the diagonally aligned upper column arm member 47 and the lower column arm member 24. As shown in the FIG. 12 drawing, the column arm members 24 and 25 have like connections at each end through seat fittings 28 to the corresponding fixtures 22 of the intermediate chord frame. A total of four seat fittings 28 are thus included. In the upper column arm 47 and lower column arm 25 the W-beam sections are continuous, while the two W-beams of the column arms 49 and 24 are welded through top and bottom end stiffener center plates similar to stiffener plates 49*c*.

Figure 15:
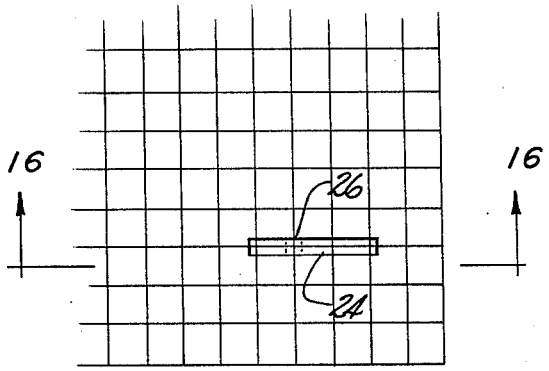
FIG. 15 is a fragmentary top plan schematic showing of a different embodiment of the present invention used in an asymmetrical space frame layout where the unbalanced loadings at the end of the asymmetrical arm could result in reasonably close moment values without inducing to the column excessive overturning moment values.
Figure 16:
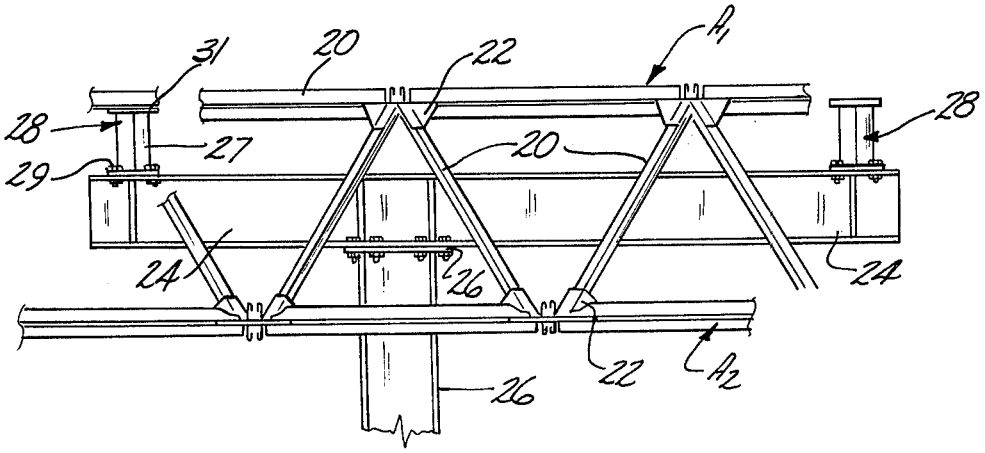
FIG. 16 is a fragmentary elevational view of the embodiment of FIG. 15 taken along the line 16—16 thereof and showing the detail of its construction.

FIGS. 15 and 16 show a still further embodiment of the present invention which relates to an asymmetrical column arm and an asymmetrical space frame layout. While the embodiment shown in the FIG. 16 drawing is directed toward a single-decked space frame, the embodiment is also applicable to a double-decked space frame. Included as the two basic elements in the support structure are the vertical column 26 and the one-way column arm member 24. In any asymmetrical layout such as shown in FIG. 15, the unbalanced loading at the end of the asymmetrical one-way column arm could result in reasonably close moment values and consequently induce to the support column 26 the minimum amount of bending moment. It will be seen that the web struts 20 serve to interconnect the upper and lower chord frame structures $A_1$ and $A_2$ and that the seat fittings 28 provide a rigid support. In one example of the application of the embodiment of FIG. 16, the left hand shorter length of the column arm 24 would have its seat fitting 28 spaced one module distance from the center of the support column 26 and carrying a load P, while the right hand support fitting 28 would be spaced substantially two module distances from the center of the support column 26 and carrying a load P/2. As a result, the left and right hand bending moments are both equal to the product PM.

Figure 17:
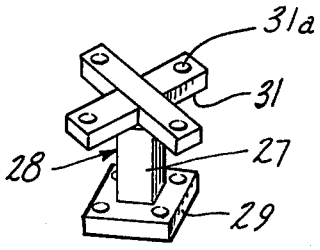
FIG. 17 is a perspective view of a seat fitting used in several different embodiments of the present invention.
Figure 18:
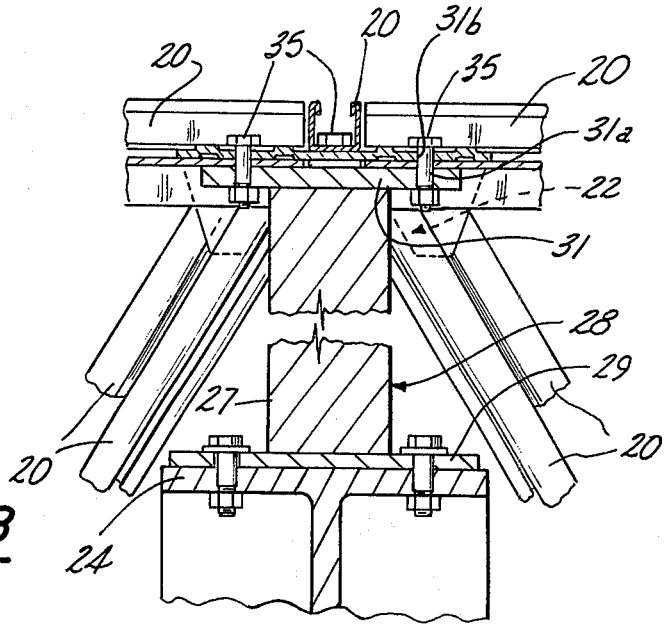
FIG. 18 is a fragmentary elevational view of a seat fitting showing its connection to the elements of a chord frame, such as in the FIG. 16 embodiment.

FIGS. 17 and 18 show the detail of the seat fittings 28 and the manner in which they are connected between the cross members 24 or 25 and the fixtures 22 of the adjacent chord frame such as chord frame $A_1$ of FIGS. 2 and 16. The cross-shaped seat 31 of the seat fitting 28 includes a plurality of apertures 31*a*, each alignable with a like aperture 31*b* formed in the flat angular surface of the associated connecting fixtures 22. A common bolt fastener 35 is used to fasten together each corresponding fixture 22, chord strut 20 and cross-shaped seat 31 as best shown in FIG. 18. Also shown is the foot portion 29 of the seat fitting 28 which comprises a flat plate.

Figure 19:
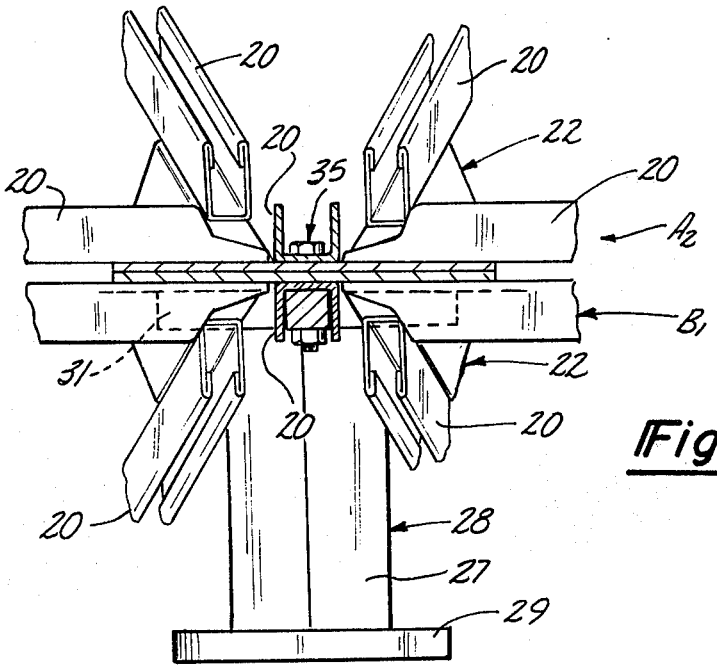
FIG. 19 is a fragmentary elevational view of a seat fitting showing its connection to the connecting fixtures of a chord frame such as in the FIG. 6 or FIG. 14 embodiments.

FIG. 19 shows an example of a pair of connecting fixtures 22 mounted in abutting relationship to provide a double connecting fixture for use, for example, in the embodiments of FIGS. 6, 10 and 14. When the seat fixtures 22 are connected in the intermediate chord formed from a chord frame $A_2$ and a chord frame $B_1$; for example, it is necessary to provide angular connecting surfaces for not two but four pairs of web struts 20. In the FIG. 19 drawing, the two fixtures 22 are mounted in back-to-back relationship with their horizontal flat portions adapted to receive the horizontal chord frame struts 20 as illustrated. Upwardly and downwardly angular attachment faces of the fixtures 22 are shown to which are attached the respective upward and downward diagonal struts 20. A suitable fastener arrangement such as a common nut and bolt fastener is used to hold together the respective chord frame struts 20, and back-to-back portions of the fixtures 22. Illustrated is the manner in which a pair of struts 20 are connected by a bolt fastener 35 to the opposed horizontal surface faces of the fixtures 22. It will further be seen from the FIG. 19 drawing that the same seat fitting 28 is used which fitting is connected by the above mentioned bolt connection to the horizontal flat face of the lower fixture 22. The seat fitting 28 in a like manner to the one in FIG. 18 includes a post portion 27, a foot portion 29 and an upper cross connecting arm 31.

It will thus be seen from the several embodiments of the present invention and from the description given in connection with those embodiments that the present invention provides an improved support structure for space frames. The invention is particularly appropriate for those space frame constructions in which the space frame spans to be supported are unusually large and in which because of the relatively great loads involved multiple deck space frames are required.

What is claimed is:

1. A support structure for a multiple-decked space frame system including a plurality of elongated stress and load transmitting struts interconnected by a plurality of stress and load distributing fixtures to define upper and lower grid-like chord frame structures disposed in spaced parallel planes, said space frames having in common an intermediate chord frame comprising their upper and lower chord frames respectively; a plurality of elongated stress and load transmitting struts each connecting respectively with fixtures of the upper and intermediate chord frame structures and the intermediate and lower chord frame structures to define a web structure intermediate said chord frame structures; and means for fastening said struts to said fixtures;; said support structure including a vertically upstanding column, a first column arm fixed to the upper end of said column, a second column arm mounted above, axially aligned with and spaced from said first column arm, a plurality of posts mounted intermediate said first and second column arms for connecting them in a rigid manner, said first column arm further having a plurality of mounting means fixed to its upper surface and engaging the opposed fixtures of said intermediate chord frame to support said intermediate chord frame.

2. The combination as set forth in claim 1 wherein said second column arm is of lesser span than said first column arm.

3. The combination as set forth in claim 2 wherein said mounting means comprises a pair of seat fittings, each mounted proximate a different end of said first column arm.

4. The combination as set forth in claim 1 wherein said column arms are arranged diagonally with respect to the struts in said chord frames.

5. The combination as set forth in claim 1 wherein said lower space frame is of substantially lesser span than said upper space frame.

6. The combination as set forth in claim 1 wherein said support structure includes a second pair of vertically spaced and aligned cross members transversely oriented relative to said first pair of cross members, respectively, each having a like connection to each other, said lower member of said second pair having a like connection to said intermediate chord frame.

7. The combination as set forth in claim 1 wherein said mounting means comprise in each case a seat fitting having a relatively large foot portion fixed to the surface of its associated cross member.

8. The combination as set forth in claim 7 wherein said seat fittings include a cross shaped seat connectible to a connecting fixture of said intermediate chord frame.

9. The combination as set forth in claim 6 wherein said lower column arms and said upper column arms in both of said pairs lie in the same respective planes, the first of said lower arms comprising a continuous beam assembly, the second of said lower arms comprising a pair of beams welded end to end proximate the column axis; the first of said upper arms aligned with the first of said lower arms and comprising a pair of beams welded end to end proximate said column axis, the second of said upper arms aligned with the second of said lower arms and comprising a continuous beam assembly.

10. A support structure for a multiple-decked space frame comprising an upper and a lower space frame assembly, each of said space frames comprising a plurality of elongated stress and load transmitting struts interconnected by a plurality of stress and load distributing fixtures to define upper and lower grid-like chord frame structures disposed in spaced parallel planes; a plurality of elongated stress and load transmitting struts, each connecting respectively with fixtures of the upper and lower chord frame structures to define a web structure intermediate said chord frame structures and means for fastening said struts to their respective fixtures; each pair of space frames of said assembly having connected in common their respective upper and lower chord frames in a common intermediate chord frame; said support column including a base column and a pair of axially aligned column arms mounted proximate the upper end of said base column, the lowermost of said column arms having a length substantially greater than that of the uppermost of said column arms; a plurality of vertical posts connected intermediate said column arms for mutually connecting said column arms in a rigid fashion; and a plurality of pedestal like mounting means mounted on the upper surfaces at the ends of said lowermost column arms and supporting the opposed fixtures of said common intermediate chord frame.

11. The combination as set forth in claim 10 wherein a second pair of like column arms to the first are arranged in a diagonal fashion relative to said first pair, said second pair of column arms being similarly connected to each other.

12. The combination as set forth in claim 11 wherein said two pairs of column arms are aligned diagonally with respect to the struts in said chord frames.

13. A support structure for a multiple-decked space frame comprising a plurality of space frame assemblies, each of said space frames comprising a plurality of elongated stress and load transmitting struts interconnected by stress and load distributing fixtures to define upper and lower grid-like chord frame structures laying in spaced parallel planes; a plurality of elongated stress and load transmitting struts, each connecting respectively with fixtures of the upper and lower chord frame structures to define a web frame structure intermediate said chord frame structures; and means for fastening said struts to their respective fixtures; each adjacent pair of said space frames having their respective upper and lower chord frame structures coupled in a common intermediate chord frame by a plurality of back-to-back fixtures; said support structure further including a substantially vertical support column and a pair of substantially parallel and vertically spaced column arms mounted proximate the upper end of said support column, the lowermost of said column arms having a length substantially greater than that of the uppermost of said column arms; means coupled intermediate said column arms for rigidly connecting them together; a plurality of connecting means mounted on the upper surface proximate the ends of said lowermost column arms and connecting between said ends and the opposed respective back-to-back fixtures of said common intermediate chord frame.

14. The combination as set forth in claim 13 wherein a second pair of aligned column arms substantially similar to the first pair are fixed to and arranged in a mutually diagonal fashion relative to the first pair of column arms, the lower of said second pair of column arms having similar connections extending to different back-to-back fixtures of said intermediate chord frame.

15. The combination as set forth in claim 14 wherein said means coupled intermediate said column arms comprise a plurality of posts having enlarged upper and lower connecting plates.

16. The combination as set forth in claim 14 wherein said fixtures, said associated struts and connecting means are all fixed one to the other by a common bolt and nut fastening means.

17. The combination as set forth in claim 13 wherein said fixtures in each case comprise a plate having both horizontally and angularly disposed attachment surfaces for coupling to said struts of said chord frames and said web frames, respectively.

18. The combination as set forth in claim 13 wherein said column arms comprise in each case a beam of the wide flange type.

19. A support structure for a space frame comprising a plurality of elongated stress and load transmitting struts interconnected by stress and load distributing fixtures to define upper and lower grid-like chord frame structures laying in spaced parallel planes; a plurality of elongated stress and load transmitting struts, each connecting respectively with fixtures of the upper and lower chord frame structures to define a web frame structure intermediate said chord frame structures; means for fastening said struts to their respective fixtures; a support column; said space frame being asymmetrically arranged relative to said column to provide an unbalanced bending moment thereto; said support structure further including a column arm fixed proximate the upper end of said support column, said column arm being fixed to said support column in an off-center manner and having its ends in supporting engagement with the fixtures of one of said chord frames to provide a substantially equal and opposite direction bending moment to said column.

20. The combination as set forth in claim 19 wherein said column arm includes a seat fitting coupled proximate each of its ends for connecting with the respective opposed fixtures; said seat fittings including a plate portion in abutment with the upper surface of said column arm, interconnecting post portion and an upper cross seat portion fastened to its opposed fixture.

21. The combination as set forth in claim 20 wherein said fixtures, said struts and said associated seat fittings are all fastened one to the other through an intermediate bolt and nut fastening means.

* * * * *